US006106332A

United States Patent [19]

Souisa

[11] Patent Number: 6,106,332

[45] Date of Patent: Aug. 22, 2000

[54] BOARD LOCK FOR ELECTRICAL CONNECTOR

[75] Inventor: Cornelius Frederik Souisa, Vught, Netherlands

[73] Assignee: The Whitaker Corporation, Wilmington, Del.

[21] Appl. No.: 09/284,271

[22] PCT Filed: Oct. 8, 1997

[86] PCT No.: PCT/IB97/01251

§ 371 Date: Apr. 12, 1999

§ 102(e) Date: Apr. 12, 1999

[87] PCT Pub. No.: WO98/16977

PCT Pub. Date: Apr. 23, 1998

[30] Foreign Application Priority Data

Oct. 15, 1996 [GB] United Kingdom ..... 9621497

[51] Int. Cl.[7] ..... H01R 13/73

[52] U.S. Cl. ..... 439/571; 439/567

[58] Field of Search ..... 439/567, 571

[56] References Cited

U.S. PATENT DOCUMENTS 4,865,555 9/1989 Assini et al. ..... 439/82
5,083,926 1/1992 Kissinger et al. ..... 439/78
5,108,308 4/1992 Northcraft et al. ..... 439/555
5,462,454 10/1995 Krämer et al. ..... 439/571

FOREIGN PATENT DOCUMENTS 0 250 097-A1 12/1987 European Pat. Off. ..... H01R 23/70
0 561 497-B1 9/1993 European Pat. Off. ..... H01R 13/658
0 632 543-A2 1/1995 European Pat. Off. ..... H01R 23/70

*Primary Examiner*—Gary F. Paumen
*Assistant Examiner*—Truc Nguyen

[57] ABSTRACT

An electrical connector assembly mountable to a substrate having an opening therein and configured to mate with a complementary connector, the connector assembly comprising a connector housing having contacts therein for mating with conductors associated with the substrate and the complementary connector, and a board-lock extending outward from the housing and receivable in the opening along a positioning portion; the connector assembly characterized in that the board-lock includes a weakened band along the positioning portion where the weakened band is located within the opening corresponding to the wall thereof, the weakened band including an engagement surface therealong, where the weakened band is constructed such that upon compression the board-lock deforms at the weakened band bringing the engagement surface against the wall of the opening.

3 Claims, 3 Drawing Sheets

BOARD LOCK FOR ELECTRICAL CONNECTOR

BACKGROUND OF THE INVENTION

1. Field of the Invention

This invention relates to electrical connector assemblies and in particular to a locking feature for affixing the connector assembly, either electrically or mechanically, to a substrate, such as a printed circuit board.

2. Summary of the Prior Art

It is common to incorporate into electrical connector assemblies a board-lock or eyelet in order to anchor the connector assembly to a substrate, such as a printed circuit board. These board-locks may take on a number of different configurations and may be made of various materials, such as a molded plastic extension of the connector housing or a metallic member either an insert or a portion of a shielding housing. In some cases it is desirable to have the option of utilizing the board-lock as a conductor and most typically as a conductor of the ground-path between the shielding associated with the connector assembly and a ground plane established on the substrate. In this case, it is known to form a board-lock insert of a conductive metal and have it electrically engaged with the shielding by such processes as soldering or a interference fit therewith. The board-locks further are received in openings or in the substrate that have conductive surfaces therein, such as plated through holes. The engagement between the conductive surfaces and the board-lock can occur through interference fit or soldering.

As soldering of the board-lock to the conductive surfaces of the opening in the substrate require relatively close tolerances both for positioning and hole size in order that the soldering is effective, additional costs are incurred in the manufacturing process. In order to avoid these additional costs associated with tighter manufacturing tolerances, there have been a number of developments in he area of more tolerance forgiving board-lock configurations. These board-lock configurations typically utilize an interference fit with the conductive surface within the opening where the boar-lock has some inherent resiliency. A example of another type of board-lock is disclose in U.S. 4,865,555. Here, a board-lock for a connector assembly is located in a housing of that assembly. The board-lock includes a positioning portion extending outward from the housing that is received within a substrate and extends therethrough. The board-lock is then compressed such that the portion extending through the substrate deforms in such a way that one connector is fixed to the substrate by the now expanded portion of the board-lock beneath the substrate.

While both these examples and other known examples perform reasonably well, there are a number of improvements that still can be addressed. Some of the components relatively complicated to manufacture and therefore add cost to the connector assembly. Others are not tolerance forgiving as might be desired for some applications. And still others may not effect the desired electrical connection with out damaging the conductive surfaces in the opening of the substrate. Finally, while it is desired to be able to form an electrical connection the board-lock still must be able to effectively mechanically engage the substrate, so it is also desired to assure good mechanical retention. Furthermore, in order to allow for manufacturing of a basic common substrate, whether or not a conductive opening is to be used, it would be desirable for the board-lock to have a wide range of engagement effectiveness so that when the opening is plated, and thereby smaller in diameter, the board-lock will make an effective engagement and if the opening is not plated, and thereby larger, the board-lock still will be able to accommodate this larger diameter.

SUMMARY OF THE INVENTION

The present invention is directed to an improved board-lock for a connector assembly. The improved board-lock is simple, provides effective engagement, accommodation of tolerancing and ease of use. An electrical assembly incorporating the present invention is as disclosed in claim 1. Advantageous features are included in the dependent claims thereof.

DETAIL DESCRIPTION OF THE PREFERRED EMBODIMENT

Figure 1:
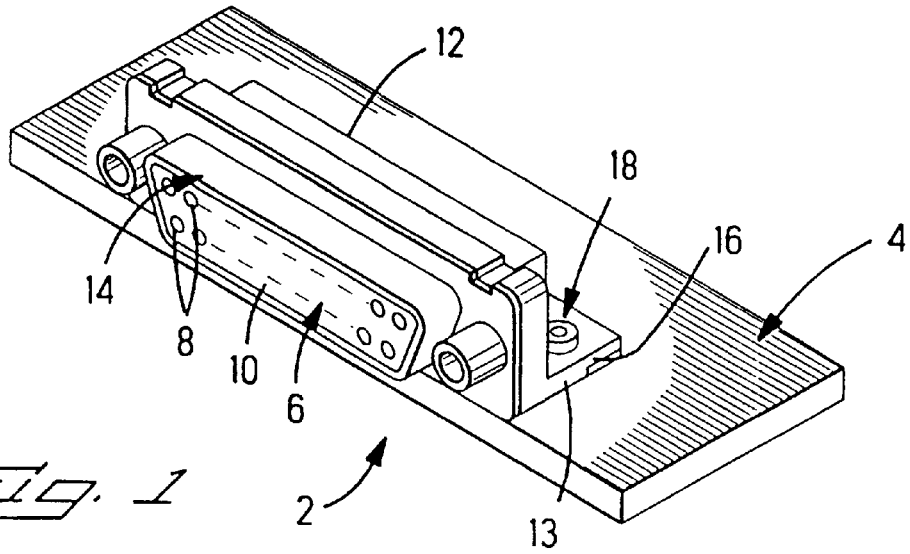
FIG. 1 is an upper side perspective view of a right angle connector assembly placed upon a substrate.

With reference first to FIG. 1, an electrical assembly particularly suited for incorporation of the present invention is shown generally at 2. The connector assembly 2 is mounted upon a substrate 4, such as a printed circuit board, that would typically have circuit traces disposed thereupon. The connector assembly 2 incorporates a basic housing 6 through which a plurality of contact receiving passageways 8 extend from a mating end 10 to a rear side 12. Electrical contacts are disposed within the passageways 8 and are adapted for mating with a complementary connector (not shown) on the mating end 10 and on the rear side 12 are configured to engage the conductive pathways on the printed circuit board 4. As this is a right angle connector, the housing 6 is further configured with L-shaped mounting features 13, such that a base 16 is established that sits upon the substrate 4. In order to anchor the connector assembly 2 to the substrate 4, board-lock components 18 would be used on either end thereof. For some applications it may be advantageous to incorporate a metal shielding shell 14 about the mating end 10 of the housing 6. Furthermore, in order to provide a ground pathway for this shielding shell 14, it may be desirable to connect the shielding shell 14 through the connector housing 6 to the board-lock member 18 as is well known in the industry. A connector assembly of the type shown here is a typical standard sub-miniature D connector.

Figure 2:
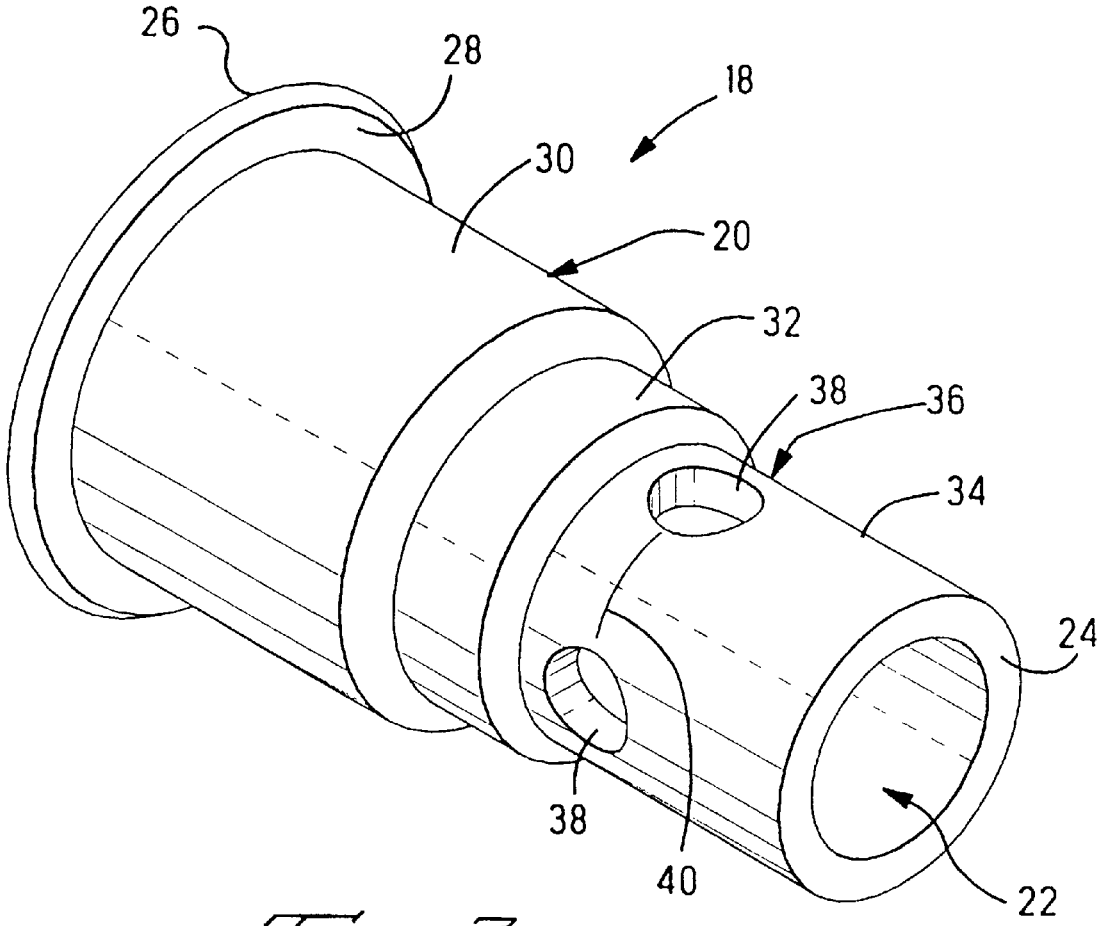
FIG. 2 is a perspective view of a board-lock component particularly suited for use with the connector assembly of FIG. 1.

While numerous types of board-locks 18 have been used in connectors of this style, the board-lock 18 according to the present invention is shown generally in FIG. 2. The board-lock 18 is of an eyelet style meaning that it includes a generally cylindrical body portion 20 having a generally concentric opening 22 extending therethrough. The board-lock 18 includes a board end 24 and a connector end 26. The connector end 26 has a flanged head portion 28 beneath which a connector sleeve portion 30 of the body 20 extends along the length of the body 20 to an intermediate flange 32. The board-lock 18 extends between the intermediate flange 32 and the board end 24 through a positioning portion 34. The positioning portion 34 is sized to be received within an opening 42 in the substrate 4 as will be described below with respect to FIG. 3. Along the positioning portion 34 is a weakened band 36 formed by a number of openings 38 that extends transversely through the body 20 and into the opening 22. The openings 38 generally define a buckling line 40 that connects the centers of radius of adjacent openings 38. The openings 38 may take on a number of forms, such that a circular radius is not realized, the buckling line 40 is defined between the two closest points of adjacent openings. Additionally, mechanical features other than openings 38 all the way through the positioning portion 34 or other processes heat, such as heat treatment processes, may be used to form the weakened band 36. The board-lock 18 may be formed of any suitable conductive material by way of stamping and rolling a flat sheet or by drawing techniques. The connector sleeve portion 30 is typically press fit into the connector assembly 2 such that the connector sleeve portion 30 is in an interference fit with either the housing 6 and/or some portion of the shielding 14. The remainder of the board-lock 18 will extend from the base surface 16 such that it would be received within corresponding openings 42 in the substrate 4.

Figure 3:
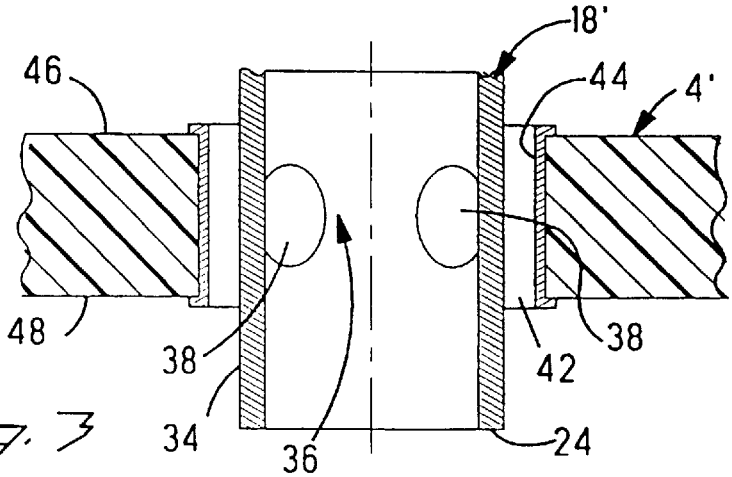
FIG. 3 is a representational view of the board-lock of FIG. 2 inserted into an opening in a substrate.
Figure 4:
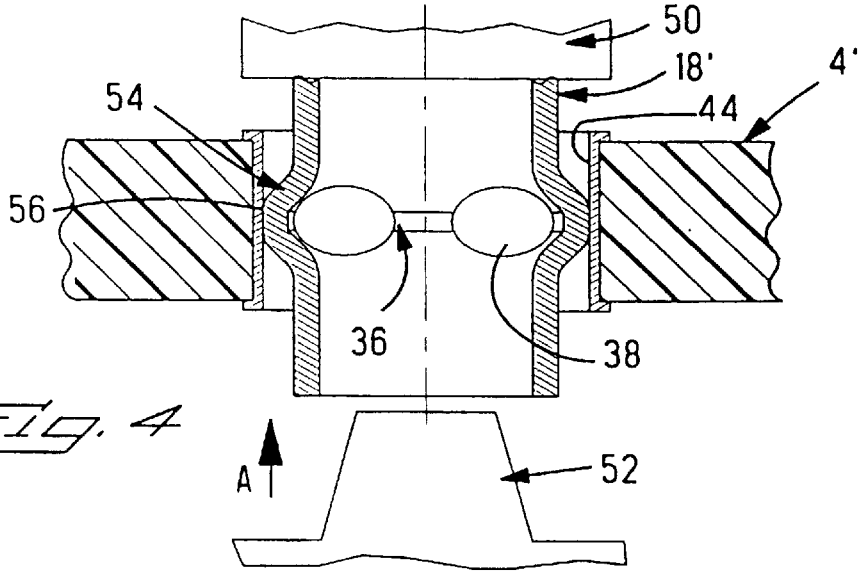
FIG. 4 is a representative sectional view of the assembly of FIG. 3 showing the board-lock engaging the substrate.

With reference now to FIG. 3, a representative view of a board-lock 18' functionally corresponding to that of the board-lock 18 of FIG. 2 is shown inserted into an opening 42 of a substrate 4'. The remainder of the connector assembly 2 has been eliminated for the sake of clarity. In addition, while the board-lock 18' is slightly different than that described in FIG. 2, common reference numbers will be used where the features correspond. In this example, the opening 42 has a wall that includes a conductive lining 44 to be engaged by the board-lock 18' in order to establish an electrical connection therewith. When the connector assembly 2 is mounted upon the substrate 4', the board end 24 and corresponding positioning portion 34 are received therein. The positioning portion 34 is sized such that the weakened band 36 that includes the openings 38 is disposed within the opening 42 between upper and lower surfaces 46, 48 of the substrate 4' respectively. With reference now to FIG. 4, in order for the board-lock 18' to function by engaging the substrate 4' representative tooling is shown as a back-up support anvil 50 and a pressing tool 52. With reference once again to FIG. 1, the back-up support anvil 50 would sit on top of the board-lock 18 once the connector assembly 2 is positioned upon the substrate 4. With further reference to FIG. 2, the support anvil 50 would sit upon the flanged head 28. In order to establish engagement with the substrate 4' by the board lock 18', the pressing tool 52 is displaced in the direction of arrow A. The force associated with this displacement is opposed by the support anvil 50.

Figure 5:
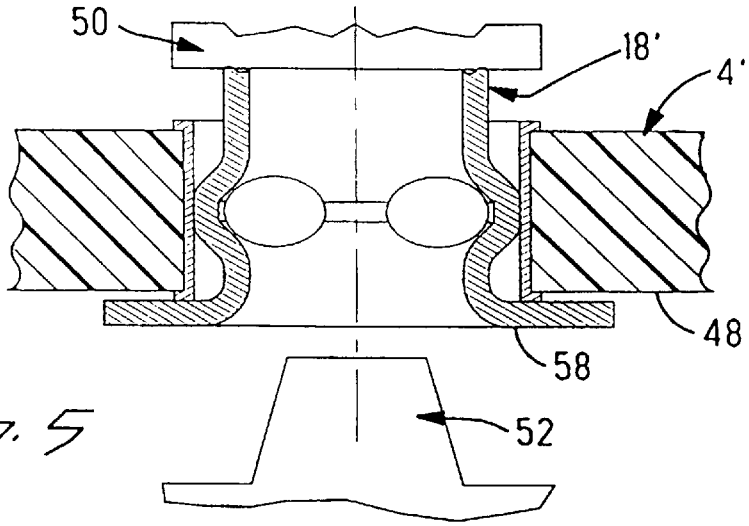
FIG. 5 is a representative sectional view according to FIG. 4 showing a further enhancement of the board-lock.

Upon exertion of sufficient force, the board-lock 18' will deform or collapse at the weakened section 36 such that a buckle 54 is formed. An engagement surface 56 of the buckle 54 interferes with the conductive sleeve 44 as the overall length of the board-lock 18' is compressed. Once sufficient force has been exerted, this interference with the conductive sleeve 44 will lock the connector assembly 2 to the substrate 4 in a reliable, mechanical and electrical engagement. If it is desired to further enhance the mechanical engagement, an additional force may be applied in the same direction such that a flange 58 is formed in the board-lock 18' upon the lower side 48 of the substrate 4'such that it is not possible to remove the board-lock therefrom as the substrate 4' would be captivated between the base 16 of the assembly 2 and the flange 58, as best seen in FIG. 5.

Figure 6:
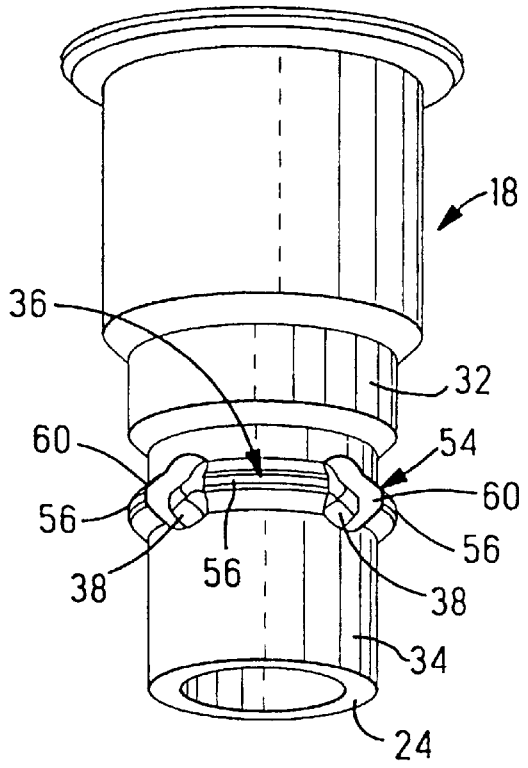
FIG. 6 is a side perspective view of the board-lock of FIG. 2 showing the board-lock in the condition in which it would engage the substrate within the opening thereof.

With reference now to FIG. 6, the board lock of FIG. 2 is shown in detail in its "buckled" state. The buckle 54 extends circumferentially around the positioning portion 34 in a location corresponding to the weakened band 36. The engagement surface 56 is the most outwardly extending portion of the buckle 54. A circumferential edge 60 of the openings 38 should not be disposed beyond the engaging surface 56 such that intersection between the circumferential edge 60 and the engaging surface 56 would bite into the conductive lining 44 to such an extent that the lining would be damaged. As a result of the shortening of the positioning portion 34 as the buckle 54 is formed, there will be a micro displacement of the engaging surface 56 against the lining 44 such that any debris or oxidation will be displaced so that a reliable electrical connection is formed.

Figure 7:
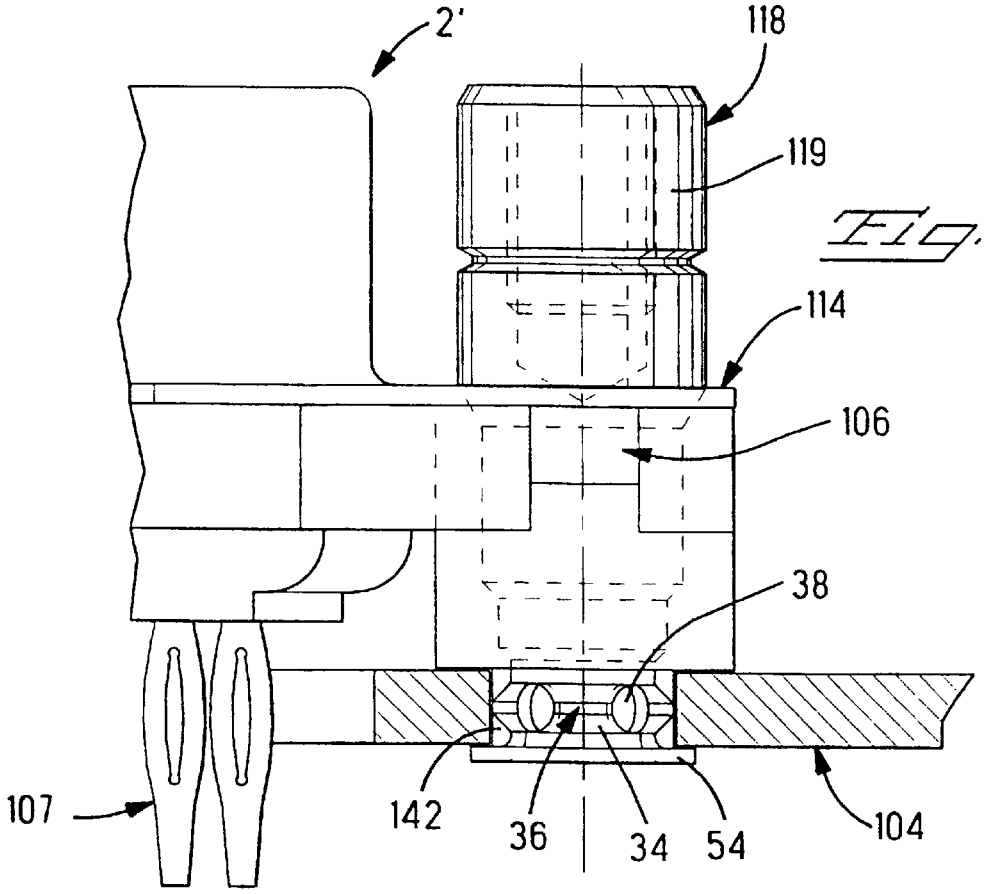
FIG. 7 is a side partially cutaway view of another embodiment of the board-lock of the present invention fixing a connector assembly to a substrate.

With reference now to FIG. 7, another embodiment of the board-lock is shown at 118 (corresponding reference numbers are given but not discussed). This board-lock 118 is configured in a manner generally corresponding to the aforedescribed and is shown incorporated into an HD-20 style connector 2' that includes plated-through-hole style contacts 107 for engaging circuit traces on substrate 104 within a housing 106. The board-lock 118, which extends through an opening 142 in the substrate 104, includes a standoff portion 119 having a threaded portion 120 for securing a mating connector (not shown)therewith. Otherwise the board-lock 118 functions and is configured as described above.

While the invention has been described generally with respect to cylindrical openings 38 as stated above, other configurations are possible. In addition, while a single weakened region 36 has been discussed it would be possible to include multiple weakened regions. In order to ensure that full engagement with the substrate 4 has occurred, it would be possible to utilize force measurement equipment with the tooling 50,52. In addition, if desired the intermediate sleeve 32 could be sized such that it is received in a portion of the opening 42 to provide some initial alignment. In addition to the advantageous features previously set forth, the aforegoing board lock 18 is especially suited for applications where the thickness between the upper and lower surfaces 46,48 of the substrate 4 vary.

What is claimed is:

1. An electrical connector assembly mountable to a substrate having an opening therein and configured to mate with a complementary connector, the connector assembly comprising:

a connector housing having contacts therein for mating with conductors associated with the substrate and the complementary connector, and a board-lock having a positioning portion extending outward from the housing that is receivable in the opening, the positioning portion being compressible to retain the connector assembly with the substrate;

the connector assembly characterized in that:

the board-lock includes a circumferentially weakened band localized longitudinally along the positioning portion where the weakened band is formed by multiple round openings and is located away from the housing a distance corresponding to the wall along the opening when the opening has appropriate dimensions, the weakened band including an engagement surface therealong, where the weakened band is constructed such that upon compression, the board-lock is deformable by buckling at the weakened band bringing the engagement surface against the wall of the opening.

2. The connector assembly of claim 1, wherein the openings are round.

3. The connector assembly of claim, wherein a portion of the board-lock extends below the substrate such that upon compression a flange is formed.

* * * * *